US005427221A

United States Patent [19]

Spriggs et al.

[11] Patent Number: 5,427,221

[45] Date of Patent: Jun. 27, 1995

[54] ESCALATOR HANDRAIL DRIVE SYSTEM

[75] Inventors: John P. Spriggs, Roswell; James F. Evans, Stockbridge, both of Ga.

[73] Assignee: Home Elevators, Inc., Roswell, Ga.

[21] Appl. No.: 241,626

[22] Filed: May 12, 1994

[51] Int. Cl.[6] ..... B66B 23/04

[52] U.S. Cl. ..... 198/335; 198/835

[58] Field of Search ..... 198/331, 335, 835

[56] References Cited

U.S. PATENT DOCUMENTS

| | | | |
|---|---|---|---|
| 3,049,213 | 8/1962 | Fabula . | |
| 3,321,060 | 5/1967 | Mullis et al. . | |
| 3,666,075 | 5/1972 | Iwata | 198/835 X |
| 4,134,883 | 1/1979 | Mendelsohn et al. | 198/335 X |
| 4,535,880 | 8/1985 | Boltrek . | |
| 4,580,675 | 4/1986 | Boltrek . | |
| 4,589,539 | 5/1986 | Boltrek . | |
| 5,072,820 | 12/1991 | Steffen et al. . | |
| 5,125,494 | 6/1992 | Nurnberg et al. . | |

FOREIGN PATENT DOCUMENTS

| | | | |
|---|---|---|---|
| 265119 | 9/1968 | Austria | 198/335 |
| 898117 | 4/1972 | Canada | 198/335 |
| 0025076 | 2/1979 | Japan | 198/335 |
| 0165990 | 1/1981 | Netherlands | 198/335 |
| 1557050 | 4/1990 | U.S.S.R. | 198/335 |
| 1557051 | 4/1990 | U.S.S.R. | 198/335 |

OTHER PUBLICATIONS

Report from U.S. Dept. of Transportation entitled "Overview of Escalator Applications in Rail Transit", dated Jul. 1, 1980.

*Primary Examiner*—D. Glenn Dayoan
*Attorney, Agent, or Firm*—Jones & Askew

[57] ABSTRACT

The present invention is an improved escalator handrail drive system. The system includes a drive wheel with an uphill and downhill side, an escalator handrail wrapped around a portion of the drive wheel, and two pressure rollers. One pressure roller is positioned adjacent to the downhill side of the drive wheel and forms a first nip therebetween and the other pressure roller is positioned adjacent to the uphill side of the drive wheel and forms a second nip therebetween. The escalator handrail is driven by the drive wheel with the assistance of the uphill pressure roller and the downhill pressure roller applying pressure to the handrail as it passes through each of the first and second nips so as to ensure sufficient contact area between the drive wheel and the handrail. There are also at least two guide rollers with at least one positioned adjacent to the downhill side of the drive wheel and at least one positioned adjacent to the uphill side of the drive wheel. The guide rollers provide for a smooth transition for the handrail as it travel around the drive wheel.

21 Claims, 2 Drawing Sheets

ESCALATOR HANDRAIL DRIVE SYSTEM

TECHNICAL FIELD

This invention relates to an improved escalator handrail drive system. More particularly, this invention relates to a drive system which provides more drive force to the handrail, but with fewer moving parts and less maintenance than is currently available with known systems.

BACKGROUND OF THE INVENTION

While escalator handrail drive systems are known in the art, existing systems are frequently subject to mechanical failure and high maintenance due to constant use. This is particularly true with respect to escalator systems used in mass transit facilities. A popular escalator system for such mass transit facilities is the Westinghouse Moduline B-100 Escalator. The Metropolitan Atlanta Rapid Transit Authority ("MARTA"), for example, has over 120 Westinghouse modular escalators with over 360 handrail drive units. The Washington Metropolitan Area Transit Authority has some 500 of these same escalators with approximately 1600 handrail drive units. MARTA has reported that in excess of twenty percent of a typical mechanic's time is expended on problems associated with the handrail drive system, leading to the desire for a replacement system requiring less maintenance.

Maintenance problems with escalators in mass transit facilities, and with the handrail drive system in particular, are well known. For example, in 1980 the Jet Propulsion Laboratory and the California Institute of Technology published a report for the U.S. Department of Transportation entitled "Overview of Escalator Applications in Rail Transit" that described the high maintenance requirements for modular escalators and detailed the maintenance history for several mass transit systems. While modular escalators have a lower capital cost than conventional escalators, modular elevators are generally known for higher maintenance costs and lower availability.

Examples of the Westinghouse modular escalator system are found in U.S. Pat. Nos. 4,535,880 to Boltrek, 4,580,675 to Boltrek, and 4,589,539 to Boltrek, et al. One version of the handrail drive system is described in detail in U.S. Pat. No. 4,580,675, particularly FIG. 6 contained therein. The system uses a drive pulley, several auxiliary pulleys, a drive belt, several traction rollers, a take up pulley, and several pressure rollers. The pressure rollers are spring driven and bias the surface of the handrail against the traction rollers for point contact. See Column 5, lines 46–53.

The specific maintenance problems with the Westinghouse handrail drive system include heavy wear on the handrail and the urethane drive rollers. This wear is caused by the spring-loaded pressure or pinch rollers located under each drive roller that rotate against the face of the handrail. Further, the use of only point contact between the pressure rollers, the handrail, and the drive rollers does not provide enough surface contact on the handrail to create the necessary drive friction. Any unexpected load on the handrail, such as a person attempting to ride on it, can cause the handrail to slip and shut the system down.

What is needed is a handrail drive system that can provide increased force to handrails while decreasing the number of required parts and the amount of required maintenance. Such an improved system would preferably fit within existing escalator systems without substantial modifications.

The present invention is an improvement upon the Westinghouse system in that it replaces the existing six-wheel roller drive system with a simplified system employing one drive wheel, one pair of pressure rollers, and one pair of guide rollers. The present invention has fewer moving parts and requires less maintenance, while exerting more drive force. This is due to the fact that both the pressure rollers and the drive wheel have a contact layer with a suitable hardness in order to squeeze the handrail between the pressure rollers and the drive wheel without causing damage. Further, the invention provides for significantly greater contact area between the drive wheel and the handrail, thereby permitting the transmission of greater drive force.

While other means of reducing handrail wear have been disclosed, such as U.S. Pat. No. 5,125,494 to Nurnberg, et al., employing the use of a slip ring to prevent the handrail from coming into contact with the drive belt, these disclosures require the use of additional moving parts, thereby leading to additional maintenance and an increased possibility of mechanical break down. The present invention, however, employs the use of an appropriate contact layer on the surface of the pressure rollers and drive wheel such that more force can be applied to the handrail with less wear than is possible with the known handrail drive systems.

SUMMARY OF THE INVENTION

Stated generally, the present invention comprises an improved escalator handrail drive system. The system comprises a drive wheel with an uphill and downhill side, an escalator handrail wrapped around a portion of the drive wheel, and two pressure rollers. One pressure roller is positioned adjacent to the downhill side of the drive wheel and forms a first nip therebetween and the other pressure roller is positioned adjacent to the uphill side of the drive wheel and forms a second nip therebetween. The escalator handrail is driven by the drive wheel with the assistance of the uphill pressure roller and the downhill pressure roller applying pressure to the handrail as it passes through each of the first and second nips so as to ensure sufficient contact area between the drive wheel and the handrail. There are also at least two guide rollers with at least one positioned adjacent to the downhill side of the drive wheel and at least one positioned adjacent to the uphill side of the drive wheel. The guide rollers provide for a smooth transition for the handrail as it travel around the drive wheel.

At least one pressure roller is positioned on each side of the drive wheel so as to contact the handrail in a radial direction towards the center of said drive wheel. The pressure rollers may be adjusted depending on the amount of force required.

The contact layer on both the pressure rollers and the drive wheel comprises a mixture with a hardness of between 73 and 83 durometer Shore A. An embodiment using a compound comprising a mixture of ethylene and propylene with a hardness of 75 durometer Shore A is disclosed. The use of this compound allows for increased force to be transmitted to the handrail by the pressure rollers and the drive wheel without causing damage to the handrail.

In use, an escalator handrail is propelled by the drive wheel with the pressure rollers squeezing the handrail against the drive wheel so as to provide for more drive surface contact. This increased surface contact provides for the transmission of increased drive force to the handrail. The guide rollers are employed to prevent kinks in the handrail as it approaches and leaves the drive wheel assembly.

The system can pull loads of at least 300 pound without slipping or stalling. In contrast, the Westinghouse system can pull only between 65 to 105 pounds. The result of this increased efficiency is that only half as many drive units may be required to pull the same load.

An embodiment of the invention is specifically designed to fit within an existing Westinghouse modular escalator system without major modifications. The existing handrail can be used in the system with slight modifications.

Thus, it is an object of the present invention to provide for an improved escalator handrail drive system.

It is a further object of the present invention to provide for an escalator handrail system that will transmit more drive force to the handrail with fewer moving parts than is possible with current systems.

It is another object of the present invention to provide for an escalator handrail drive system that has a contact layer that squeezes the handrail in order to exert superior drive force.

It is a still further objective of the present invention to provide an escalator drive system that will be easy to install and requires no major modifications of the existing system.

Other objectives, features and advantages of the present invention will become apparent upon reading the following specification, when taken in conjunction with the drawings and the claims.

DETAILED DESCRIPTION

Figure 1:
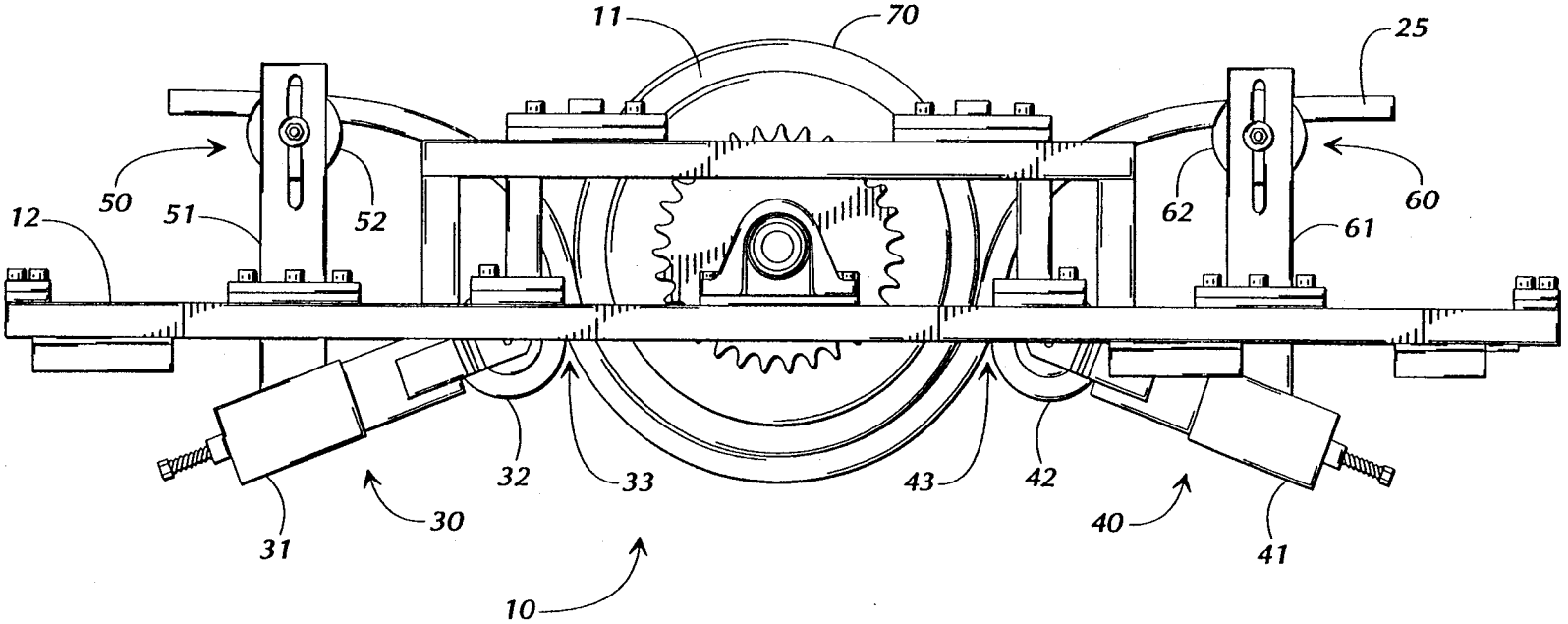
FIG. 1 is a perspective view showing the relationship of the elements that comprise the improved handrail drive system, namely, a drive wheel, a handrail, pressure roller assemblies, and guide roller assemblies.

FIG. 1 is a perspective view showing the relationship of the elements that comprise the improved handrail drive system 10, namely, a drive wheel 11, a handrail 25, pressure roller assemblies 30, 40, and guide roller assemblies 50, 60. The drive wheel 11 is mounted to a frame 12 by means of a drive axle 13 and pillow block bearings 14. The drive wheel 11 has an uphill and a downhill side. The uphill pressure roller assembly 30 is mounted to the frame 12 on the uphill side of the drive wheel 11 and the downhill pressure roller assembly 40 is mounted to the frame 12 on the downhill side of the drive wheel 11. The uphill pressure roller assembly 30 consists of an uphill pressure roller bracket 31 and an uphill pressure roller wheel 32. Likewise, the downhill pressure roller assembly 40 consists of a downhill pressure roller bracket 41 and a downhill pressure roller wheel 42.

The uphill pressure roller assembly 30 is positioned a sufficient distance from the drive wheel 11 such that an uphill nip 33 is formed therebetween. Likewise, the downhill pressure roller assembly 40 is positioned a sufficient distance from the drive wheel 11 such that a downhill nip 43 is formed therebetween. The handrail 25 travels between and through both the uphill nip 33 and the downhill nip 43 such that it is wrapped around the lower portion of the drive wheel 11.

Both of the pressure roller assemblies 30, 40 are positioned on the frame 12 such that they force the handrail 25 against the drive wheel 11 to ensure sufficient drive surface contact. Likewise, the pressure roller assemblies 30, 40 are positioned on the frame 12 such that they contact the handrail 25 in a radial direction towards the center of drive wheel 11 and therefore ensure the maximum transmission of force. Both of the pressure roller assemblies 30, 40 can be adjusted so as to increase the amount of force imparted to the handrail 25.

In addition to the use the pressure roller assemblies 30, 40, the invention also comprises the use of at least two guide roller assemblies 50, 60. The guide roller assemblies 50, 60 prevent the handrail 25 from developing kinks near and around the drive wheel 11. Further, the use of the guide roller assemblies 50, 60 reduce the amount of force needed to drive the handrail 25 by eliminate the need for several of the existing idler rollers found in the Westinghouse system.

The uphill guide roller assembly 50 is mounted on the frame 12 on the uphill side of the drive wheel 11. The uphill guide roller assembly 50 consists of an uphill guide frame 51 and an uphill guide roller 52. Likewise, the downhill guide roller assembly 60 is located on the downhill side of the drive wheel 11. The downhill guide roller assembly 60 consists of a downhill guide frame 61 and a downhill guide roller 62.

The disclosed embodiment employs the drive wheel 11 with a diameter of approximately 18 inches, including the contact layer 70 with a depth of approximately 1 inch, and a width of approximately 1-7/16 inch. The pressure roller wheels 32, 42 have a diameter of approximately 5 inches, including the contact layer 70 with a depth of approximately 1 inch, and a width of approximately 2 inches. The guide rollers 52, 62 have an inner barrel diameter of approximately 2 inches, a rim diameter of approximately 6 inches, and a width of approximately 3½ inches. The frame 12 is constructed out of 1½ inch steel tubing with a thickness of approximately 3/16 inch.

The drive wheel 11, the uphill pressure roller wheel 32, and the downhill pressure roller wheel 42 each have a contact layer 70 that permits the pressure roller wheels 32, 42 to exert a significant amount of force on the handrail 25 against the drive wheel 11 without causing damage to the handrail 25. A material that is too hard does not provide sufficient traction to drive the handrail 25 without slippage, while a material that is too soft tends to pull apart from the drive wheel 11 or the pressure roller wheels 32, 42. A compound with a hardness of 73 to 83 durometer Shore A is employed. This hardness factor is provided by an elastomer comprising of a mixture of ethylene and propylene, specifically ethylene propylene diene monomer or "EPDM" (also known as "EPT," "EP," "EPR," "Nordel," and "Royalene.") The EPDM rubber compound comprising the contact layer 70 has a hardness of 75 durometer Shore A.

Figure 2:
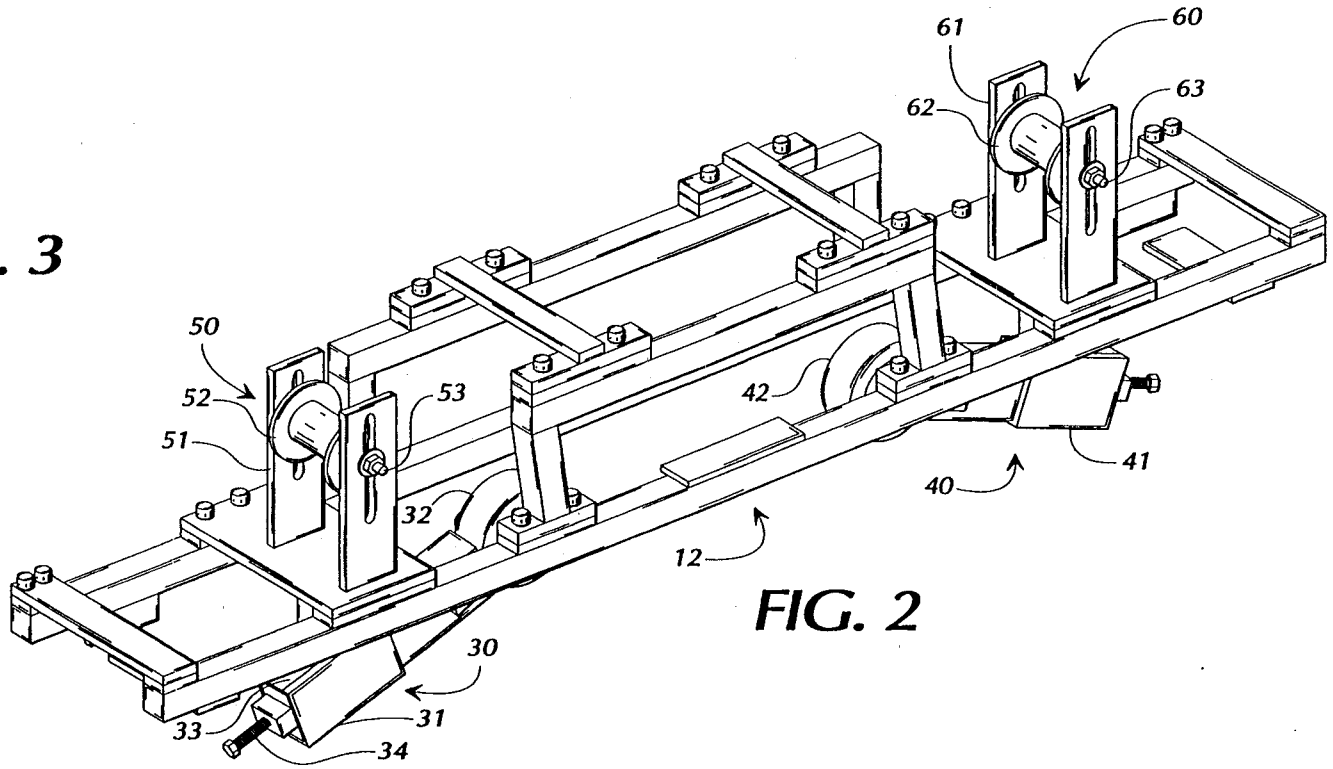
FIG. 2 is a side perspective view showing the relationship of the pressure roller assembly and the guide roller assembly.

FIG. 2 is a side perspective view showing the relationship of the uphill pressure roller assembly 30 and the uphill guide roller assembly 50. The same discussion is applicable to the downhill pressure roller assembly 40 and the downhill guide roller assembly 60. The uphill guide roller assembly 50 is secured into place on the frame 12 on the uphill side of the drive wheel 11. The uphill guide frame 51 is welded to the frame 12 or attached by other suitable means. The uphill guide roller 52 is then mounted on the top end of the uphill guide frame 51 by means of a ball bearing assembly 53 for rotation thereon. The uphill guide roller 52 is of spool-like shape such that the handrail 25 is maintained on an accurate course when entering and exiting the drive wheel 11.

Similarly, the uphill pressure roller assembly 30 is secured to the frame 12 on the uphill side of drive wheel 11 as described above. The uphill pressure roller bracket 31 is secured by suitable means, such as welding or bolting, to an angled spacer block 33. The angled spacer block 33 is then secured to the frame 12 by suitable means, such as welding or bolting, to ensure that the uphill pressure roller bracket 31 is positioned at the appropriate angle with respect to the drive wheel 11 such that the uphill pressure roller wheel 32 asserts force against the handrail 25 in the direction of the center of drive wheel 11. The pressure roller wheels 32, 42 are positioned below the equator of the drive wheel 11 but above the bottom pole of the drive wheel 11. In the disclosed embodiment, the uphill pressure roller assembly 30 is positioned at approximately 20 degrees off of the horizontal base of the frame 12. The uphill pressure roller wheel 32 is attached to the uphill pressure roller bracket 31 via an adjustable bolt 34. The force that the uphill pressure roller wheel 32 exerts on the handrail 25 can be varied via an adjustable bolt 34.

Figure 3:
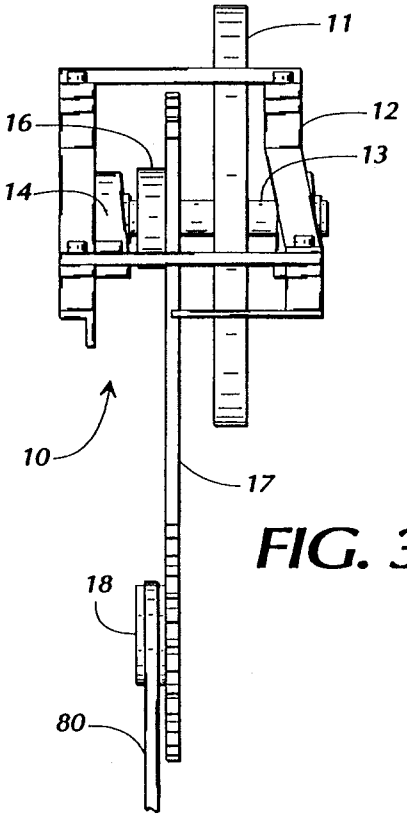
FIG. 3 is a side perspective view of the improved handrail drive system.

FIG. 3 is a side perspective view of the improved handrail drive system 10. As described above, the drive wheel 11 is fixedly mounted to the frame 12 by axle 13 within the pillow block bearings 14. Also fixedly mounted on the axle 13 is a wheel chain sprocket 16. The wheel chain sprocket 16 is driven by a roller chain 17 attached to a main drive chain sprocket 18. The main drive chain sprocket 18 engages the main drive chain 80 of the escalator step. It is understood that the main drive chain is driven by the main power source of the escalator. The roller chain 17 may also be tensioned by a tensioner sprocket assembly (not shown).

The improved drive system 10 is designed to be mounted within a typical escalator system, such as a Westinghouse Moduline B-100 escalator system. To install the system 10, the existing handrail 25 must be lengthened by approximately 10 inches. The existing six wheel roller drive handrail system is removed and is replaced with the frame 12. The frame 12 is slightly angled towards the top in order to fit within the existing escalator skin. An angle of approximately 6 degrees is disclosed.

The original belt drive sprocket is removed from the escalator main drive chain of the existing escalator system and is replaced in the disclosed embodiment with the main drive chain sprocket 18 which is a 28 tooth sprocket. The roller chain 17 is attached to the main drive chain sprocket 18 and the wheel chain sprocket 16 via the tensioner sprocket assembly 19. In the disclosed embodiment, the roller chain 17 is an 80 roller chain and the wheel chain sprocket 18 is a 32 tooth sprocket. The handrail 25 is positioned around the drive wheel 11, and the axle 13 is then locked into place within the pillow block bearings 14. The uphill pressure roller assembly 30 and the downhill pressure roller assembly 40 are then adjusted via the pressure roller adjustment bolt 65.

Thus the invention features the use of the drive wheel 11 with the pressure roller assemblies 30, 40, and the guide roller assemblies 50, 60 mounted onto the frame 12. In use, the handrail travels over the uphill guide roller assembly 50 through the uphill nip 33, around the drive wheel 25, through the downhill nip 43, and over the downhill guide roller assembly 60. The invention features the use of the contact layer 70 on the drive wheel 25 and the pressure roller wheels 32, 42 with a hardness of 73 to 83 durometer Shore A. The resultant advantages of the invention include the ability to provide more drive force to the escalator handrail 25 with fewer parts and maintenance than is currently available. Another advantage is the ability of the invention to squeeze the handrail 25, without damaging it, so as to transmit increased drive force.

While the invention has been disclosed with respect to an escalator handrail drive system, it will be appreciated that the invention is equally well suited for other types of belt drive system employing the use of a flexible belt. It is also to be understood that this description is not meant to be limiting because further modifications may now suggest themselves to those skilled in the art and is intended to cover such modifications as fall within the scope of the following claims.

We claim:

1. An improved escalator handrail drive system for mounting in a modular escalator truss, comprising:

a drive wheel assembly comprising a drive wheel having an uphill and downhill side and sized to fit within said modular escalator truss:

an escalator handrail wrapped around a portion of said drive wheel:

two bolt-loaded pressure rollers;

one of said pressure rollers positioned adjacent to said downhill side of said drive wheel and forming a first nip therebetween for said handrail and the other of said pressure rollers positioned adjacent to said uphill side of said drive wheel and forming a second nip therebetween for said handrail;

said escalator handrail being driven by said drive wheel with the assistance of said uphill pressure roller and said down hill pressure roller applying pressure to said handrail as it passes through each of said first and second nips;

at least two guide rollers:

at least one of said guide rollers positioned adjacent to said downhill side of said drive wheel and at least one of said guide rollers positioned adjacent to said uphill side of said drive wheel;

said guide rollers providing a smooth transition for said escalator handrail around said drive wheel.

2. The improved escalator handrail drive system of claim 1 wherein said drive wheel assembly further comprises:

a drive axle;

a wheel chain sprocket;

said drive wheel and said wheel chain sprocket fixedly mounted to said drive axle;

a main drive chain sprocket engaged with the main drive chain of an escalator for rotation therewith: and a roller chain:

said roller chain connecting said wheel chain sprocket and said main drive chain sprocket such that force from said main drive chain is transmitted to said wheel chain sprocket and said drive wheel.

3. The improved escalator handrail drive system of claim 1 wherein said pressure rollers and said drive wheel each have a EPDM rubber contact layer thereon with a hardness range of 73 to 83 durometer Shore A.

4. The improved escalator handrail drive system of claim 1 wherein said pressure rollers and said drive wheel each have a EPDM rubber contact layer thereon with a hardness of approximately 75 durometer Shore A.

5. The improved escalator handrail drive system of claim 1 wherein said pressure rollers and said drive wheel each have a contact layer thereon comprising an elastomer compound having a mixture of ethylene and propylene.

6. The improved escalator handrail drive system of claim 1 wherein said escalator handrail can pull loads of at least 300 pounds without slippage.

7. The improved escalator handrail drive system of claim 1 wherein said pressure rollers are adjustable so as to vary the amount of force which is transmitted to said handrail.

8. The improved escalator handrail drive system of claim 1 wherein said pressure rollers are positioned adjacent to said drive wheel such that said pressure rollers contact said handrail in a radial direction towards the center of said drive wheel.

9. The improved escalator handrail drive system of claim 1 wherein said drive wheel has an equator and a pole on one end and wherein said pressure rollers are positioned adjacent to said drive wheel between said equator and said pole on one end.

10. An improved escalator handrail drive system for mounting within a modular escalator truss, comprising:

a drive wheel having an uphill and downhill side and sized to fit within said modular escalator truss;

an escalator handrail wrapped around a portion of said drive wheel;

two bolt-loaded pressure rollers:

one of said pressure rollers positioned adjacent to said downhill side of said drive wheel and forming a first nip therebetween for said handrail and the other of said pressure rollers positioned adjacent to said uphill side of said drive wheel and forming a second nip therebetween for said handrail;

both of said pressure rollers being positioned adjacent to said drive wheel such that both of said pressure rollers contact said handrail in a radial direction towards the center of said drive wheel;

said escalator handrail being driven by said drive wheel with the assistance of said uphill pressure roller and said down hill pressure roller applying pressure to said handrail as it passes through each of said first and second nips;

at least two guide rollers;

at least one of said guide rollers positioned adjacent to said downhill side of said drive wheel and at least one of said guide rollers positioned adjacent to said uphill side of said drive wheel;

said guide rollers providing a smooth transition for said escalator handrail around said drive wheel.

11. The improved escalator handrail drive system of claim 10 wherein said pressure rollers and said drive wheel each have a EPDM rubber contact layer thereon with a hardness range of 73 to 83 durometer Shore A.

12. The improved escalator handrail drive system of claim 10 wherein said pressure rollers and said drive wheel each have a EPDM rubber contact layer thereon with a hardness of approximately 75 durometer Shore A.

13. The improved escalator handrail drive system of claim 10 wherein said pressure rollers and said drive wheel each have a contact layer thereon comprising an elastomer compound having a mixture of ethylene and propylene.

14. The improved escalator handrail drive system of claim 10 wherein said escalator handrail can pull loads of at least 300 pounds without slippage.

15. The improved escalator handrail drive system of claim 10 wherein said pressure rollers are adjustable so as to vary the amount of force which is transmitted to said handrail.

16. The improved escalator handrail drive system of claim 10 wherein said drive wheel has an equator and a pole on one end and wherein said pressure rollers are positioned adjacent to said drive wheel between said equator and said pole on one end.

17. An improved escalator handrail drive system for mounting in a modular escalator truss, comprising:

a drive wheel having an uphill and downhill side and sized to fit within said modular escalator truss;

an escalator handrail wrapped around a portion of said drive wheel;

two bolt-loaded pressure rollers;

one of said pressure rollers positioned adjacent to said downhill side of said drive wheel and forming a first nip therebetween for said handrail and the other of said pressure rollers positioned adjacent to said uphill side of said drive wheel and forming a second nip therebetween for said handrail;

said pressure rollers and said drive wheel each having an EPDM rubber contact layer thereon;

said escalator handrail being driven by said drive wheel with the assistance of said uphill pressure roller and said down hill pressure roller applying pressure to said handrail as it passes through each of said first and second nips;

at least two guide rollers;

at least one of said guide rollers positioned adjacent to said downhill side of said drive wheel and at least one of said guide rollers positioned adjacent to said uphill side of said drive wheel;

said guide rollers providing a smooth transition for said escalator handrail around said drive wheel.

18. The improved escalator handrail drive system of claim 17 wherein said pressure rollers are positioned adjacent to said drive wheel such that said pressure rollers contact said handrail in a radial direction towards the center of said drive wheel.

19. The improved escalator handrail drive system of claim 17 wherein said drive wheel has an equator and a pole on one end and wherein said pressure rollers are positioned adjacent to said drive wheel between said equator and said pole on one end.

20. The improved escalator handrail drive system of claim 1 wherein said pressure rollers and said drive wheel each have an EPDM rubber contact layer thereon.

21. The improved escalator handrail drive system of claim 10 wherein said pressure rollers and said drive wheel each have an EPDM rubber contact layer thereon.

* * * * *